US010269547B2

(12) United States Patent
Brown et al.

(10) Patent No.: US 10,269,547 B2
(45) Date of Patent: Apr. 23, 2019

(54) PROCESSING MASS SPECTRAL DATA

(71) Applicant: MICROMASS UK LIMITED, Wilmslow, Cheshire (GB)

(72) Inventors: Jeffery Mark Brown, Hyde (GB); Keith George Richardson, Derbyshire (GB); Richard Chapman, Runcorn (GB)

(73) Assignee: MICROMASS UK LIMITED, Wilmslow (GB)

( * ) Notice: Subject to any disclaimer, the term of this patent is extended or adjusted under 35 U.S.C. 154(b) by 239 days.

(21) Appl. No.: 15/293,916

(22) Filed: Oct. 14, 2016

(65) Prior Publication Data

US 2017/0110304 A1 Apr. 20, 2017

(30) Foreign Application Priority Data

Oct. 16, 2015 (GB) ..... 1518391.6

(51) Int. Cl.
*H01J 49/00* (2006.01)
*H01J 49/40* (2006.01)

(52) U.S. Cl.
CPC ..... *H01J 49/0036* (2013.01); *H01J 49/40* (2013.01)

(58) Field of Classification Search
CPC .... H01J 49/0036; H01J 49/40; H01J 49/0009; H01J 49/022
USPC ..... 702/127, 189, 190
See application file for complete search history.

(56) References Cited

U.S. PATENT DOCUMENTS 4,371,535 A 2/1983 Unemi et al.
6,590,204 B2 7/2003 Baranov
7,987,060 B2 * 7/2011 Lange ..... G06K 9/00523 250/282

FOREIGN PATENT DOCUMENTS

WO 01/27857 4/2001

OTHER PUBLICATIONS

Li, X et al., "*A Wavelet-Based Data Pre-Processing Analysis Approach in Mass Spectrometry*", Computers in Biology and Medicine, vol. 37, pp. 509-516 (2007).
Shao et al., "Automatic Baseline Correction by Wavelet Transform for Quantitative Open Path Fourier Transform Infrared Spectroscopy", Environ. Sci. Technol., vol. 41, pp. 7054-7059, 2007.
Kast et al., "Noise Filtering Techniques for Electrospray Quadrupole Time of Flight Mass Spectra", Am. Soc. Mass Spec., vol. 14, pp. 766-776, 2003.
Gentzel et al., "A Novel Spectra Processing Algorithm for MALDI TOF/TOF Fragment Spectra for Automated Protein Identification", European Molecular Biology Laboratory, p. 1283, 2005.

* cited by examiner

*Primary Examiner* — An H Do

(57) ABSTRACT

A method of mass spectrometry is disclosed that includes transforming mass spectral data to produce frequency-domain mass spectral data, modifying the frequency-domain mass spectral data to produce modified frequency-domain mass spectral data by attenuating and/or removing one or more ranges of the frequency-domain mass spectral data that relate to noise associated with peaks of interest in the mass spectral data, and transforming the modified frequency-domain mass spectral data to produce modified mass spectral data.

19 Claims, 6 Drawing Sheets

PROCESSING MASS SPECTRAL DATA

CROSS-REFERENCE TO RELATED APPLICATION

This application claims priority from and the benefit of United Kingdom patent application No. 1518391.6 filed on 16 Oct. 2015. The entire content of this application is incorporated herein by reference

FIELD OF THE INVENTION

The present invention relates generally to mass spectrometers and in particular to the processing of mass spectral data from Time of Flight ("ToF") mass spectrometers.

BACKGROUND OF THE INVENTION

Mass spectral data acquired using a mass spectrometer, such as a Time of Flight ("ToF") mass spectrometer, can suffer from undesirable peak skirting or baseline rising. This can be due, for example, to incomplete desolvation of the Liquid Chromatography ("LC") eluent supplied to the mass spectrometer or to ions colliding with residual gas in the mass analyser.

Collisions of ions with gas in the mass analyser can cause ions to fragment and release energy thereby causing either an acceleration or deceleration of the product ions. If this occurs, for example, in the field free region of a reflectron Time of Flight ("ToF") mass analyser or in a linear Time of Flight ("ToF") mass analyser then the ion peak widths are increased and undesirable peak skirts are produced in the resulting mass spectral data. The degree to which these effects occur depends on the ratio of the number of ions that collide during their time of flight (which is a function of their collisional cross section and the background pressure) to the number of ions that do not collide, as well as the energy released during the collision process (known as the "Derrick Shift") which causes product ions to change speed relative to their corresponding parent or precursor ion.

Kast et al., "Noise Filtering Techniques for Electrospray Quadrupole Time of Flight Mass Spectra", J. Am. Soc. Mass Spectrom. 2003, 14, 766-776 discloses removing periodically repeating chemical background noise peaks from Time of Flight ("ToF") mass spectral data by manually selecting and eliminating individual peaks in the Fourier spectrum of the mass-to-charge ratio ("m/z") domain data. However, this approach does not address the problem of undesirable peak skirting effects.

It is therefore desired to provide an improved method of mass spectrometry.

SUMMARY OF THE INVENTION

According to an aspect there is provided a method of mass spectrometry comprising:

transforming mass spectral data to produce frequency-domain mass spectral data;

modifying the frequency-domain mass spectral data to produce modified frequency-domain mass spectral data by attenuating and/or removing one or more ranges of the frequency-domain mass spectral data that relate to noise associated with peaks of interest in the mass spectral data; and transforming the modified frequency-domain mass spectral data to produce modified mass spectral data.

Various embodiments relate to methods of mass spectrometry in which mass spectral data is transformed to obtain frequency-domain mass spectral data. In the context of this application "frequency-domain" is intended to mean the space that is dual to mass or mass to charge ratio under the specified integral transform or discrete version of an integral transform. The frequency-domain mass spectral data is then modified by attenuating one or more ranges of the transformed frequency-domain mass spectral data to obtain modified frequency-domain mass spectral data. The modified frequency-domain mass spectral data is transformed back to obtain modified mass spectral data.

As will be described in more detail below, the Applicants have been able to address the problem of peak skirting and baseline rising effects in mass spectral data as described above.

It should be noted here that although it is common to apply Fast Fourier Transform ("FFT") methods in some types of mass spectrometry, such as in Fourier Transform Ion Cyclotron Resonance ("FTICR") mass spectrometry or in electrostatic mass spectrometry that uses electrostatic fields having a quadro-logarithmic potential distribution, this is done to convert the acquired data into the mass-to-charge ratio ("m/z") domain since in these techniques the mass-to-charge ratio of ions is related to the frequencies of the acquired data. Hence, in these techniques, frequency-domain mass spectral data is not transformed to produce modified mass spectral data.

In contrast, it is not necessary or typical to use such methods for Time of Flight ("ToF") mass spectral data (or other mass-to-charge ratio-domain or time-domain mass spectral data) since the mass-to-charge ratio can be directly determined from the acquired time of flight data by simply squaring the times of flight. Furthermore, unlike FTICR data, there are no overlapping ions in the spectra.

In the article Kast et al., "Noise Filtering Techniques for Electrospray Quadrupole Time of Flight Mass Spectra", J. Am. Soc. Mass Spectrom. 2003, 14, 766-776 a method is disclosed wherein periodically repeating chemical background noise peaks are removed from Time of Flight ("ToF") mass spectral data by manually selecting and eliminating individual peaks in the Fourier spectrum of the mass-to-charge ratio ("m/z") domain data.

It will be apparent, however, that the approach disclosed in Kast is quite different to the methods according to various embodiments and in particular that the approach disclosed in Kast is unable to address the problem of peak skirting effects.

In particular, according to various embodiments transformed frequency-domain mass spectral data is modified by attenuating and/or removing one or more ranges of the frequency-domain mass spectral data that relate to noise associated with (i.e. localized to) peaks of interest in the mass spectral data.

Accordingly, the present disclosure is based on the recognition that the techniques described herein can be effective in removing noise artefacts associated with peaks of interest i.e. the removal of non-repeating peak skirting or peak tailing and baseline rising effects, such as peak localized background, in mass spectral data as described above.

In particular, the quality of the mass spectral data may be improved by attenuating ranges of frequencies that in essence represent undesirable baseline noise artefacts locally associated with and exhibited between peaks of interest (i.e. non-repeating baseline rising adjacent to peaks of interest). Thus, the techniques described herein can be used to provide improved mass spectral data.

It will be appreciated therefore, that various embodiments provide significant improvements and improved methods of mass spectrometry.

The mass spectral data and/or the modified mass spectral data may comprise time-domain mass spectral data.

The method may further comprise determining mass to charge ratio-domain mass spectral data from the modified mass spectral data.

The mass spectral data may comprise Time of Flight ("ToF") mass spectral data.

The mass spectral data may comprise a plurality of time-intensity pairs.

The mass spectral data and/or the modified mass spectral data may be transformed using: (i) a Fourier Transform; (ii) a Fast Fourier Transform ("FFT"); (iii) a wavelet transform; (iv) a discrete wavelet transform; (v) a continuous wavelet transform; and/or (vi) any other integral transform or discrete version of an integral transform.

The one or more ranges may be selected on the basis of the average number of collisions experienced by ions corresponding to peaks of interest in the mass spectral data.

The one or more ranges may be selected on the basis of the collisional cross section ("CCS") of ions corresponding to peaks of interest in the mass spectral data.

The mass spectral data may be transformed using a forward transform and the modified frequency-domain mass spectral data may be transformed using a reverse transform.

The mass spectral data may be transformed using a reverse transform and the modified frequency-domain mass spectral data may be transformed using a forward transform.

Modifying the frequency-domain mass spectral data may comprise attenuating and/or removing frequencies from the frequency-domain mass spectral data that are above and/or below one or more threshold frequencies.

The one or more threshold frequencies may comprise: (i) about 0.5 MHz; (ii) about 1 MHz; (iii) about 1.5 MHz; (iv) about 2 MHZ; (v) about 2.5 MHz; (vi) about 3 MHz; (vii) about 3.5 MHZ; (viii) about 4 MHz; (ix) about 5 MHz; (x) about 6 MHz; (xi) about 7 MHz; (xii) about 8 MHz; (xiii) about 9 MHz; (xiv) about 10 MHz; (xv) about 11 MHz; (xvi) about 12 MHz; (xvii) about 13 MHz; (xviii) about 14 MHz; (xix) about 15 MHz; (xx) about 16 MHz; (xxi) about 17 MHz; (xxii) about 18 MHz; (xxiii) about 19 MHz; and/or (xxiv) about 20 MHz.

Modifying the frequency-domain mass spectral data may comprise attenuating and/or removing frequencies from the frequency-domain mass spectral data in the range: (i) about 0-0.5 MHz; (ii) about 0.5-1 MHz; (iii) about 1-1.5 MHz; (iv) about 1.5-2 MHZ; (v) about 2-2.5 MHz; (vi) about 2.5-3 MHz; (vii) about 3-3.5 MHZ; (viii) about 3.5-4 MHz; (ix) about 4-5 MHz; (x) about 5-6 MHz; (xi) about 6-7 MHz; (xii) about 7-8 MHz; (xiii) about 8-9 MHz; (xiv) about 9-10 MHz; (xv) about 10-11 MHz; (xvi) about 11-12 MHz; (xvii) about 12-13 MHz; (xviii) about 13-14 MHz; (xix) about 14-15 MHz; (xx) about 15-16 MHz; (xxi) about 16-17 MHz; (xxii) about 17-18 MHz; (xxiii) about 18-19 MHz; (xxiv) about 19-20 MHz; and/or (xxv) >20 MHz.

Modifying the frequency-domain mass spectral data may comprise attenuating and/or removing the one or more ranges of the frequency-domain mass spectral data using one or more step, window, apodization or tapering functions.

The one or more window, apodization or tapering functions may comprise a function that comprises:

a maximum frequency and a minimum frequency;

wherein the function is relatively high below the maximum frequency and above the minimum frequency; and wherein the function is relatively low above the maximum frequency and below the minimum frequency.

The function may be non-zero below the maximum frequency and above the minimum frequency; and the function may be about zero above the maximum frequency and below the minimum frequency.

The function may comprise an apodization or tapering function that falls smoothly to about zero at the maximum frequency and/or at the minimum frequency.

The one or more step, apodization or tapering functions may comprise a function that comprises:

a maximum frequency;

wherein the function is relatively high below the maximum frequency; and wherein the function is relatively low above the maximum frequency.

The function may be non-zero below the maximum frequency; and the function may be about zero above the maximum frequency.

The function may comprise an apodization or tapering function that falls smoothly to about zero at the maximum frequency.

The one or more step, apodization or tapering functions may comprise a function that comprises:

a minimum frequency;

wherein the function is relatively high above the minimum frequency; and wherein the function is relatively low below the minimum frequency.

The function may be non-zero above the minimum frequency; and the function may be about zero below the minimum frequency.

The function may comprise an apodization or tapering function that falls smoothly to about zero at the minimum frequency.

The minimum and/or maximum frequency may comprise: (i) about 0 MHz; (ii) about 0.5 MHz; (iii) about 1 MHz; (iv) about 1.5 MHz; (v) about 2 MHZ; (vi) about 2.5 MHz; (vii) about 3 MHz; (viii) about 3.5 MHZ; (ix) about 4 MHz; (x) about 5 MHz; (xi) about 6 MHz; (xii) about 7 MHz; (xiii) about 8 MHz; (xiv) about 9 MHz; (xv) about 10 MHz; (xvi) about 11 MHz; (xvii) about 12 MHz; (xviii) about 13 MHz; (xix) about 14 MHz; (xx) about 15 MHz; (xxi) about 16 MHz; (xxii) about 17 MHz; (xxiii) about 18 MHz; (xxiv) about 19 MHz; and/or (xxv) about 20 MHz.

The frequency-domain mass spectral data may be modified in a pre-defined manner which does not depend on the mass spectral data and/or the frequency-domain mass spectral data.

The method may be performed automatically without user interaction.

The method may further comprise acquiring the mass spectral data using a mass spectrometer.

The steps of transforming the mass spectral data, modifying the frequency-domain mass spectral data and transforming the modified frequency-domain mass spectral data may be performed in real-time concurrent with the step of acquiring the mass spectral data.

According to another aspect there is provided apparatus comprising:

a device arranged and adapted to transform mass spectral data to produce frequency-domain mass spectral data;

a device arranged and adapted to modify the frequency-domain mass spectral data to produce modified frequency-domain mass spectral data by attenuating and/or removing one or more ranges of the frequency-domain mass spectral data that relate to noise associated with peaks of interest in the mass spectral data; and a device arranged and adapted to transform the modified frequency-domain mass spectral data to produce modified mass spectral data.

The mass spectral data and/or the modified mass spectral data may comprise time-domain mass spectral data.

The apparatus may be arranged and adapted to determine mass-to-charge ratio-domain mass spectral data from the modified mass spectral data.

The mass spectral data may comprise Time of Flight ("ToF") mass spectral data.

The mass spectral data may comprise a plurality of time-intensity pairs.

The apparatus may be arranged and adapted to transform the mass spectral data and/or the modified mass spectral data using (i) a Fourier Transform; (ii) a Fast Fourier Transform ("FFT"); (iii) a wavelet transform; (iv) a discrete wavelet transform; (v) a continuous wavelet transform; and/or (vi) any other integral transform or discrete version of an integral transform.

The apparatus may be configured to select the one or more ranges on the basis of the average number of collisions experienced by ions corresponding to peaks of interest in the mass spectral data.

The apparatus may be configured to select the one or more ranges on the basis of the collisional cross section ("CCS") of ions corresponding to peaks of interest in the mass spectral data.

The apparatus may be arranged and adapted to transform the mass spectral data using a forward transform and to transform the modified frequency-domain mass spectral data using a reverse transform.

The apparatus may be arranged and adapted to transform the mass spectral data using a reverse transform and to transform the modified frequency-domain mass spectral data using a forward transform.

The apparatus may be arranged and adapted to modify the frequency-domain mass spectral data by attenuating and/or removing frequencies from the frequency-domain mass spectral data that are above and/or below one or more threshold frequencies.

The one or more threshold frequencies may comprise: (i) about 0.5 MHz; (ii) about 1 MHz; (iii) about 1.5 MHz; (iv) about 2 MHZ; (v) about 2.5 MHz; (vi) about 3 MHz; (vii) about 3.5 MHZ; (viii) about 4 MHz; (ix) about 5 MHz; (x) about 6 MHz; (xi) about 7 MHz; (xii) about 8 MHz; (xiii) about 9 MHz; (xiv) about 10 MHz; (xv) about 11 MHz; (xvi) about 12 MHz; (xvii) about 13 MHz; (xviii) about 14 MHz; (xix) about 15 MHz; (xx) about 16 MHz; (xxi) about 17 MHz; (xxii) about 18 MHz; (xxiii) about 19 MHz; and/or (xxiv) about 20 MHz.

The apparatus may be arranged and adapted to modify the frequency-domain mass spectral data by attenuating and/or removing frequencies from the frequency-domain mass spectral data in the range: (i) about 0-0.5 MHz; (ii) about 0.5-1 MHz; (iii) about 1-1.5 MHz; (iv) about 1.5-2 MHZ; (v) about 2-2.5 MHz; (vi) about 2.5-3 MHz; (vii) about 3-3.5 MHZ; (viii) about 3.5-4 MHz; (ix) about 4-5 MHz; (x) about 5-6 MHz; (xi) about 6-7 MHz; (xii) about 7-8 MHz; (xiii) about 8-9 MHz; (xiv) about 9-10 MHz; (xv) about 10-11 MHz; (xvi) about 11-12 MHz; (xvii) about 12-13 MHz; (xviii) about 13-14 MHz; (xix) about 14-15 MHz; (xx) about 15-16 MHz; (xxi) about 16-17 MHz; (xxii) about 17-18 MHz; (xxiii) about 18-19 MHz; (xxiv) about 19-20 MHz; and/or (xxv) >20 MHz.

The apparatus may be arranged and adapted to modify the frequency-domain mass spectral data by attenuating and/or removing the one or more ranges of the frequency-domain mass spectral data using one or more step, window, apodization or tapering functions.

The one or more window, apodization or tapering functions may comprise a function that comprises:

a maximum frequency and a minimum frequency;

wherein the function relatively high below the maximum frequency and above the minimum frequency; and wherein the function is relatively low above the maximum frequency and below the minimum frequency.

The function may be non-zero below the maximum frequency and above the minimum frequency; and the function may be about zero above the maximum frequency and below the minimum frequency.

The function may comprise an apodization or tapering function that falls smoothly to about zero at the maximum frequency and/or at the minimum frequency.

The one or more step, apodization or tapering functions may comprise a function that comprises:

a maximum frequency;

wherein the function is relatively high below the maximum frequency; and wherein the function is relatively low above the maximum frequency.

The function may be non-zero below the maximum frequency; and the function may be about zero above the maximum frequency.

The function may comprise an apodization or tapering function that falls smoothly to about zero at the maximum frequency.

The one or more step, apodization or tapering functions may comprise a function that comprises:

a minimum frequency;

wherein the function is relatively high above the minimum frequency; and wherein the function is relatively low below the minimum frequency.

The function may be non-zero above the minimum frequency; and the function may be about zero below the minimum frequency.

The function may comprise an apodization or tapering function that falls smoothly to about zero at the minimum frequency.

The minimum and/or maximum frequency may comprise: (i) about 0 MHz; (ii) about 0.5 MHz; (iii) about 1 MHz; (iv) about 1.5 MHz; (v) about 2 MHZ; (vi) about 2.5 MHz; (vii) about 3 MHz; (viii) about 3.5 MHZ; (ix) about 4 MHz; (x) about 5 MHz; (xi) about 6 MHz; (xii) about 7 MHz; (xiii) about 8 MHz; (xiv) about 9 MHz; (xv) about 10 MHz; (xvi) about 11 MHz; (xvii) about 12 MHz; (xviii) about 13 MHz; (xix) about 14 MHz; (xx) about 15 MHz; (xxi) about 16 MHz; (xxii) about 17 MHz; (xxiii) about 18 MHz; (xxiv) about 19 MHz; and/or (xxv) about 20 MHz.

The apparatus may be arranged and adapted to modify the frequency-domain mass spectral data in a pre-defined manner which does not depend on the mass spectral data and/or the frequency-domain mass spectral data.

The apparatus may be arranged and adapted to transform the mass spectral data to produce the frequency-domain mass spectral data, to modify the frequency-domain mass spectral data to produce the modified frequency-domain mass spectral data, and to transform the modified frequency-domain mass spectral data to produce the modified mass spectral data automatically without user interaction.

According to another aspect there is provided a mass spectrometer comprising the apparatus described above.

The mass spectrometer may be arranged and adapted to acquire the mass spectral data.

The apparatus may be arranged and adapted to transform the mass spectral data, modify the frequency-domain mass spectral data and transform the modified frequency-domain mass spectral data in real-time concurrent with the acquisition of the mass spectral data.

According to another aspect there is provided a method comprising:

providing time of flight data (in an embodiment time-intensity pairs) to a Fast Fourier Transform ("FFT") processor to generate frequency domain data;

digitally manipulating ranges of frequencies from the frequency domain data in order to enhance spectral quality through the removal of chemical or electrical noise; and reconstructing the time of flight data via inverse FFT algorithm from the manipulated frequency domain.

The spectrometer may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The ion-molecule reaction device may be configured to perform ozonlysis for the location of olefinic (double) bonds in lipids.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

Optionally, in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

Optionally, in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

A chromatography detector may be provided, wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION OF THE INVENTION

Figure 1:
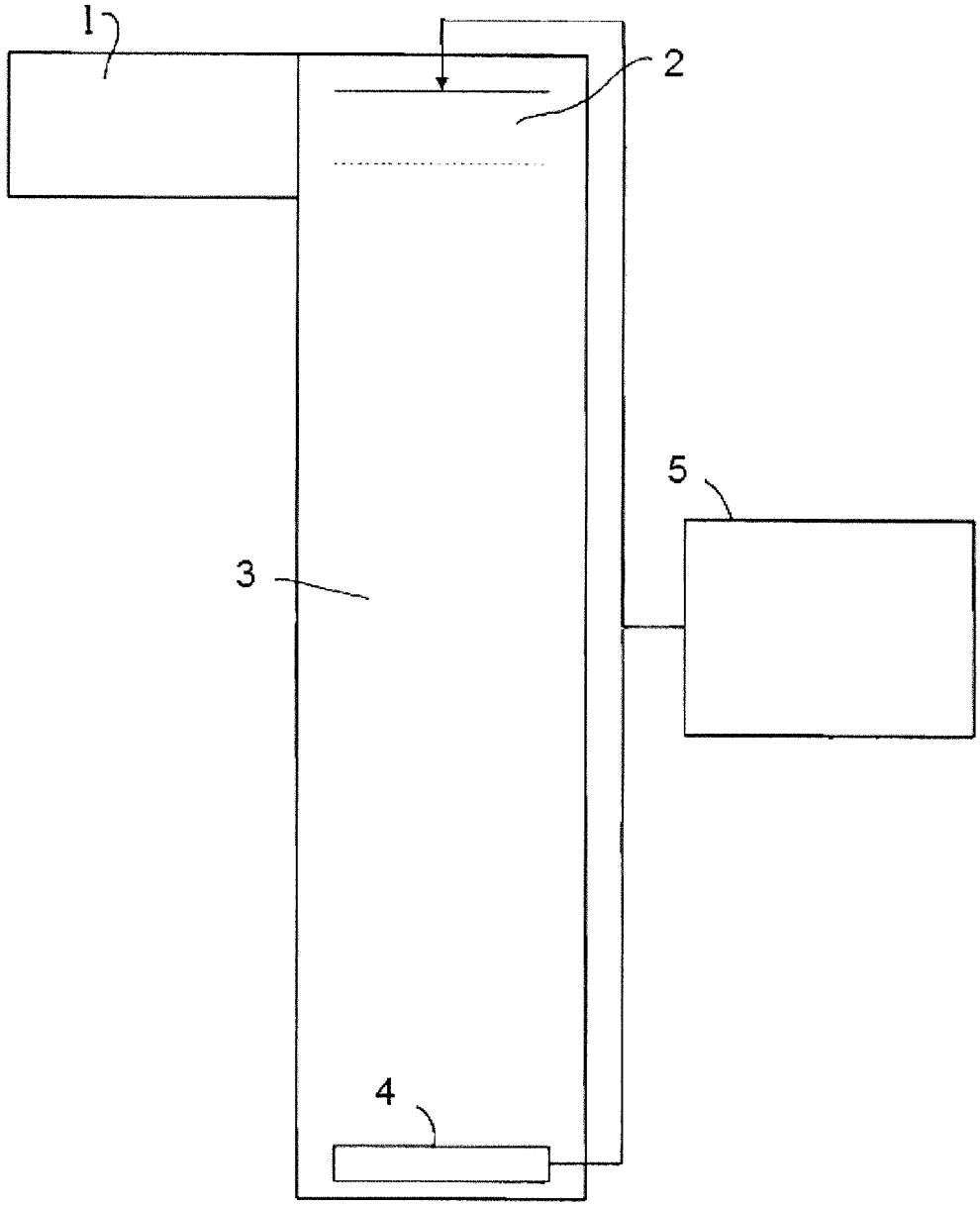
FIG. 1 shows a Time of Flight ("ToF") mass spectrometer that may be operated in accordance with an embodiment.

Various embodiments will now be described. FIG. 1 shows a Time of Flight ("ToF") mass spectrometer according to an embodiment comprising one or more upstream stages 1, an acceleration region 2, a field free or drift region 3, an ion detector 4 arranged at the exit region of the field free or drift region 4 and a control system 5.

Ions formed in the one or more upstream stages 1 of the mass spectrometer are arranged to enter the acceleration region 2 where they are driven by an acceleration pulse applied to an acceleration electrode into the field free or drift region 3. The ions are accelerated to a velocity determined by the energy imparted by the acceleration pulse and the mass or mass to charge ratio of the ions. Ions having a relatively low mass to charge ratio achieve a relatively high velocity and reach the ion detector 4 prior to ions having a relatively high mass to charge ratio.

Thus, ions arrive at the ion detector 4 after a time determined by their velocity and the distance travelled which enables the mass or mass to charge ratio of the ions to be determined. Each ion or groups of ions arriving at the detector 4 is sampled by the detector 4, and the control system 5 determines a value indicative of the time of flight and/or mass-to-charge ratio ("m/z") of the ion or group of ions. Data for multiple ions may be collected and combined to generate a Time of Flight ("ToF") spectrum and/or a mass spectrum.

According to various embodiments, for each ion or group of ions arriving at the detector 4, the detector 4 will produce a pulse, which may then be digitised by the control system 5 and converted into a time-intensity pair, i.e. a data value comprising a time of flight value together with an intensity value. In these embodiments, multiple such time-intensity pairs may be collected and combined e.g. histogrammed, to generate the Time of Flight ("ToF") spectrum and/or a mass spectrum.

Thus, in various embodiments, time-domain and/or mass-to-charge ratio-domain mass spectral data is acquired using a mass spectrometer. Where time-domain mass spectral data is acquired, it may optionally be converted into mass-to-charge ratio-domain mass spectral data.

In various embodiments, the acquired mass spectral data is subjected to digital signal filtering techniques such as Fast Fourier Transform ("FFT") digital signal filtering techniques (e.g. using the control system 5) to improve the quality of the mass spectral data.

In particular and as discussed above, according to various embodiments, the acquired mass spectral data is transformed to obtain frequency-domain mass spectral data (to obtain transformed mass spectral data). In the context of this application "frequency-domain" is intended to mean the space that is dual to mass or mass to charge ratio under the specified integral transform or discrete version of an integral transform. The frequency-domain mass spectral data (the transformed mass spectral data) is then modified by attenuating one or more ranges of the frequency-domain mass spectral data (of the transformed mass spectral data) (e.g. using one or more step, window, apodization or tapering functions) to obtain modified frequency-domain mass spectral data (to obtain modified transformed mass spectral data), and then the modified frequency-domain mass spectral data (the modified transformed mass spectral data) is transformed to obtain modified mass spectral data.

According to various embodiments, the mass spectral data is processed in a way that removes localized baseline aberrations typically associated and adjacent to peaks of interest, e.g. by applying a Fast Fourier Transform ("FFT") and apodization. These techniques are particularly beneficial in the analysis of intact monoclonal antibodies ("MAB").

The procedure may include: providing time of flight data (e.g. time intensity pairs) to a Fast Fourier Transform ("FFT") processor to generate frequency domain data, digitally manipulating ranges of frequencies from the frequency domain data in order to enhance the spectral quality through the removal of chemical or electrical noise, and reconstructing the time of flight data via an inverse Fast Fourier Transform ("FFT") algorithm from the manipulated frequency domain. Thus, one or more frequency ranges of the frequency-domain mass spectral data may be attenuated or removed using one or more step, window, apodization or tapering functions. The output data comprises a spectrum of improved quality.

It will be appreciated that these techniques recognize that data processing of Time of Flight ("ToF") mass spectral data via apodization of the transformed frequency domain data has benefits in improving data quality through the removal of peak tailing and peak localized background subtraction.

In particular, the prevalence of peak skirting or baseline rising, e.g. due to incomplete desolvation or collisions with residual gas in the Time of Flight ("ToF") mass analyser can be reduced or removed, e.g. by the attenuation of ranges of frequencies that in essence represent undesirable baseline noise artefacts locally associated with and exhibited between peaks of interest (non-repeating baseline rising adjacent to peaks of interest).

Thus, the one or more step, window, apodization or tapering functions may be configured so as to attenuate and/or remove one or more ranges of the frequency-domain mass spectral data that relate to non-repeating noise artefacts that may be associated with peaks of interest. The frequencies of the frequency-domain mass spectral data that are attenuated and/or removed may be pre-defined, i.e. independently of the acquired mass spectral data. For example, frequencies of the frequency-domain mass spectral data above and/or below one or more pre-defined threshold frequencies may be attenuated and/or removed.

Figure 2:
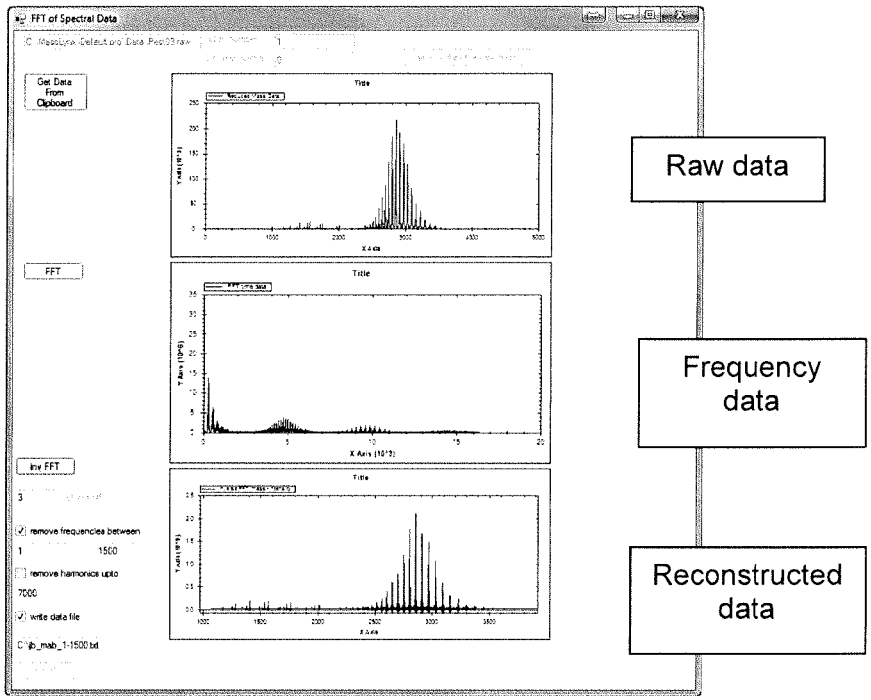
FIG. 2 shows a computer program in accordance with an embodiment in which raw data is transformed to produce frequency-domain data and the frequency-domain data is modified and transformed to produce reconstructed data.

FIG. 2 illustrates a data processing Fast Fourier Transform ("FFT") program in accordance with various embodiments.

By taking the Fast Fourier Transform ("FFT") of raw Time of Flight ("ToF") mass spectral data (i.e. not mass-to-charge ratio ("m/z") domain data) and removing frequencies of up to approximately 2 MHz (i.e. using a step function or top-hat function), and then reconstructing the Time of Flight ("ToF") mass spectral data using an inverse Fast Fourier Transform ("FFT"), it can be seen that unwanted signal between the glycosylated peaks is attenuated and the spectral quality is improved. This is because for each peak of interest the output spectrum begins to "ring" on each side of the peak of interest as the frequencies are attenuated.

Figure 3:
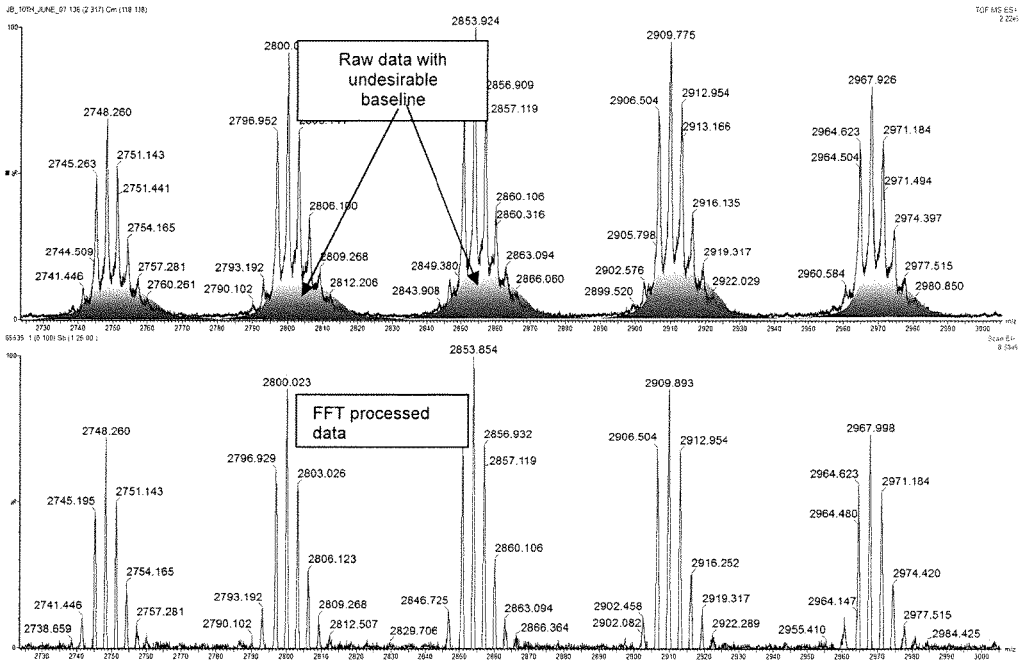
FIG. 3 shows raw Time of Flight mass spectral data and Time of Flight mass spectral data that has been processed in accordance with an embodiment.
Figure 4:
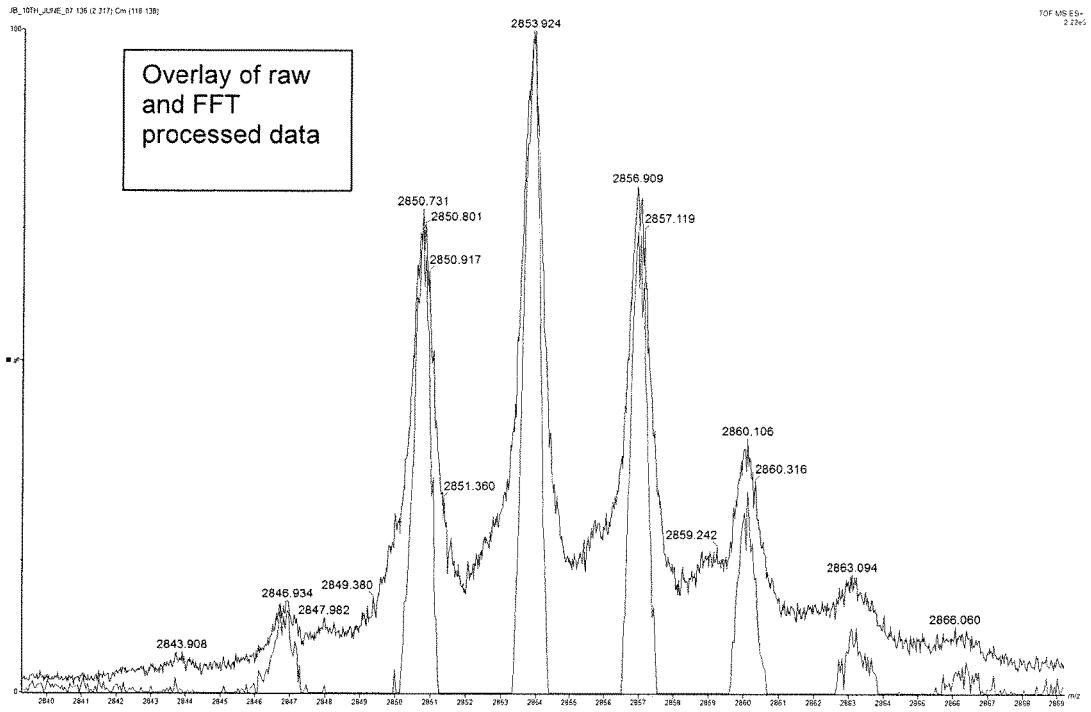
FIG. 4 shows overlaid raw Time of Flight mass spectral data and Time of Flight mass spectral data that has been processed in accordance with an embodiment.

FIGS. 3 and 4 show example spectra, where there is clear evidence for the removal of the baseline artefact peaks situated beneath the glycosylated monoclonal antibody peaks.

Figure 5:
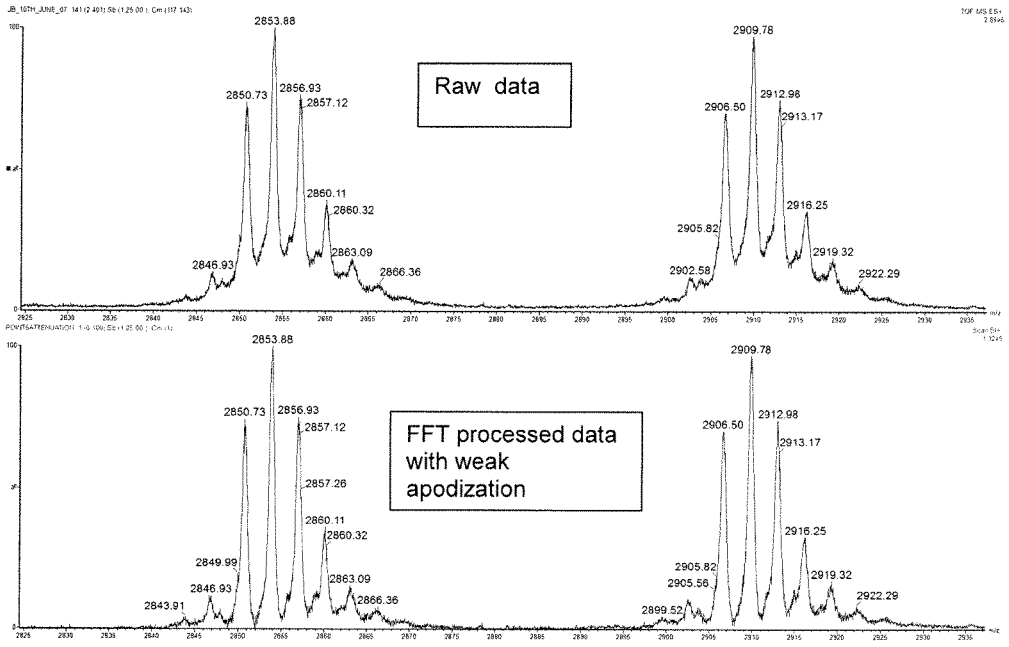
FIG. 5 shows raw Time of Flight mass spectral data and Time of Flight mass spectral data that has been processed in accordance with an embodiment.

Further enhancement of the data processing method may be achieved using shaped frequency filtering masks (i.e. apodization functions, i.e. functions that fall smoothly to zero at their minimum and/or maximum values) to reduce the ringing effect caused by the use of a step function or top-hat function. This can address the fact that in the example shown in FIG. 3 the data goes below zero which can obscure minor non-artefact peaks occurring in the valleys. Further tuning of the apodization function can reduce the "ringing" effect so that any minor peaks occurring adjacent to larger peaks can still be observed. FIG. 5 shows a spectrum comparing the raw data with data processed using an apodization function.

Although the above embodiments have been described in terms of performing a forward Fast Fourier Transform ("FFT"), applying an apodization function and then applying a reverse Fast Fourier Transform ("FFT"), it would also be possible to use other transform methods, such as discrete or continuous wavelet transform methods. Thus, according to various embodiments, the mass spectral data and/or the modified mass spectral data may be transformed using: (i) a Fourier Transform; (ii) a Fast Fourier Transform ("FFT"); (iii) a wavelet transform; (iv) a discrete wavelet transform; (v) a continuous wavelet transform; and/or (vi) any other integral transform or discrete version of an integral transform.

Similarly, the mass spectral data may be transformed using a forward transform and the modified frequency-domain mass spectral data may be transformed using a reverse transform, or alternatively the mass spectral data may be transformed using a reverse transform and the modified frequency-domain mass spectral data may be transformed using a forward transform.

The techniques described herein may be performed during "on the fly" acquisition (in real-time), e.g. where processing occurs in bespoke firmware/hardware or one or more digital signal processors ("DSP"). Thus, the techniques may be performed automatically without user interaction.

Although the above embodiments have been described in terms of removing low frequency noise, it would also be possible to remove or attenuate high frequency noise and its harmonics.

According to an embodiment, Fast Fourier Transform ("FFT") or other transform methods may also be used to remove electronic noise frequencies and harmonics in the time domain from mass spectral data.

Figure 6:
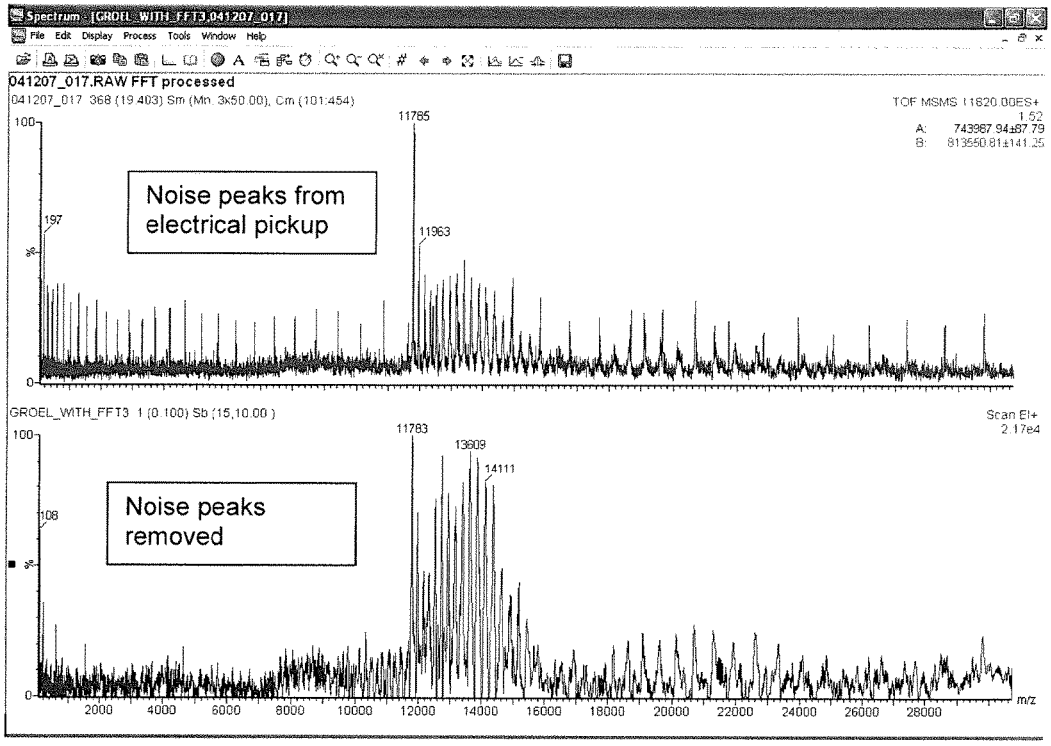
FIG. 6 shows raw Time of Flight mass spectral data and Time of Flight mass spectral data that has been processed in accordance with an embodiment.

FIG. 6 shows example spectra where noise peaks from electrical pickup are removed using the Fast Fourier Transform ("FFT") methods.

The techniques described herein may also be applied to data acquired using others types of Time of Flight ("ToF") mass spectrometer, and more generally to data acquired using other types of mass spectrometer e.g. that produce time-domain and/or mass-to-charge ratio-domain mass spectral data.

It will be appreciated that the algorithm according to various embodiments removes instrumental aberration associated with each mass spectral peak, where the aberration appears as skirts around each ion peak and tends to cause broadening and loss of resolution.

Various embodiments work by attenuating only a relatively small fraction of low frequency components of the frequency-domain data.

Various embodiments are not limited to the mass to charge ratio ("m/z") scale spectral data but can equally be applied to time domain Time-of Flight ("TOF") scale spectral data. Various embodiments in effect look for low frequency variations in signal typically associated with aberrations in analyte signals as a result of collisions with residual gas.

According to various embodiments, peak skirting artefacts are reduced by attenuating a low frequency range of the frequency-domain mass spectral data.

According to various further embodiments, the range over which the frequency-domain data is attenuated and/or removed is selected on the basis of the average number of collisions that it is estimated that the detected ions will have experienced, e.g. on the basis of the collisional cross section ("CCS") of the detected ions.

The peak aberrations (e.g. peak skirting) that are addressed by various embodiments may originate from collisions of ions with residual gas in the Time of Flight ("TOF") mass analyser. These collisions may cause deviations in the velocities of the ions. The degree of aberration may depend on the probability of the analyte ion colliding with residual gas molecules, and the manner in which the Time of Flight ("TOF") system deals with in-flight changes in energy.

The probability of an analyte ion having colliding with a gas molecule is dependent on the collisional cross section of the analyte ion with respect to the background gas, the partial pressure in the Time of Flight ("TOF") flight path, and the path length that the analyte ion travels in the residual gas within the Time of Flight ("TOF") flight path.

Consider, for example, a monoclonal antibody ("mAb") being analysed with the following parameters:

molecular weight=147 kDa;

charges=50;

kinetic energy ("KE")=10000 eV per charge;

TOF path length=2 m;

Collisional Cross Section ("CCS")=7000 Angstroms$^2$; and pressure=$5\times10^{-7}$ mB.

It can be calculated that the mean free path is approximately 1.2 m, so it can be estimated that an ion will, on average, collide 1.7 times on its journey through the TOF mass analyser.

The Applicants have recognised that the degree of broadening of the signal (the magnitude of the peak skirting) is a function of the average number of collisions that each ion species experiences.

Since the Collisional Cross Section ("CCS") of the analyte peaks are known, or alternatively can be measured using an ion mobility separation device or otherwise estimated (e.g. for unknown ions), and since also all of the other parameters are known, the mean free path and the approximate number of collisions experienced for each peak can be calculated.

According to various embodiments, for any or each peak of interest in the mass spectral data, the correction to the frequency-domain data can be applied (or not) as required, and/or in varying degrees, e.g. dependent upon the number of collisions that it is estimated that the ions that contribute to the peak will have experienced. This can further improve the quality of the mass spectral data.

According to various such embodiments, for peaks where the Collisional Cross Section ("CCS") is unknown, the Collisional Cross Section ("CCS") can be approximated based on the mass to charge ratio ("m/z") measured from the spectrum, using $CCS \approx k*mass^{2/3}$.

Accordingly, in various embodiments, the frequency-domain mass spectral data is selectively modified depending on the estimated magnitude of peak broadening (peak skirting), i.e. depending on the estimated number of collisions or the Collisional Cross Section ("CCS") of ions, e.g. that contribute to mass spectral peaks of interest in the mass spectral data.

The one or more ranges of frequency-domain mass spectral data that are attenuated and/or removed may be selected on the basis of the estimated magnitude of peak broadening (peak skirting), e.g. for each mass spectral peak of interest. The one or more ranges of frequency-domain mass spectral data that are attenuated and/or removed may be selected on the basis of the estimated number of collisions experienced by ions that contribute to one or more or each of the mass spectral peaks that appear in the mass spectral data.

In particular, the one or more ranges of frequency-domain mass spectral data that are attenuated and/or removed may be selected on the basis of the Collisional Cross Section ("CCS") of ions that contribute to one or more or each of the mass spectral peaks that appear in the mass spectral data.

In these embodiments, the Collisional Cross Section ("CCS") of ions that contribute to each mass spectral peak may be known (e.g. where the mass spectral peak corresponds to a known ion species), and/or alternatively may be determined (e.g. using a mobility separation device) and/or estimated (e.g. on the basis of the mass to charge ratio of the mass spectral peak).

As will be appreciated by those having skill in the art, various embodiments provide improved data quality and provide an alternative method of background subtraction.

Although the present invention has been described with reference to preferred embodiments, it will be understood by those skilled in the art that various changes in form and detail may be made without departing from the scope of the invention as set forth in the accompanying claims.

The invention claimed is:

1. A method of mass spectrometry comprising:

obtaining time-domain mass spectral data using a Time of Flight ("ToF") mass analyser;

transforming the mass spectral data to produce frequency-domain mass spectral data;

modifying said frequency-domain mass spectral data to produce modified frequency-domain mass spectral data by attenuating and/or removing one or more ranges of said frequency-domain mass spectral data that relate to peak skirting noise associated with peaks of interest in said mass spectral data by attenuating and/or removing frequencies from said frequency-domain mass spectral data that are below a threshold frequency; and transforming said modified frequency-domain mass spectral data to produce modified time-domain mass spectral data.

2. A method as claimed in claim 1, further comprising determining mass-to-charge ratio-domain mass spectral data from said modified time-domain mass spectral data.

3. A method as claimed in claim 1, wherein said mass spectral data comprises Time of Flight ("ToF") mass spectral data.

4. A method as claimed in claim 1, wherein said mass spectral data comprises a plurality of time-intensity pairs.

5. A method as claimed in claim 1, wherein said mass spectral data and/or said modified mass spectral data is transformed using (i) a Fourier Transform; (ii) a Fast Fourier Transform ("FFT"); (iii) a wavelet transform; (iv) a discrete wavelet transform; (v) a continuous wavelet transform; and/or (vi) any other integral transform or discrete version of an integral transform.

6. A method as claimed in claim 1, wherein said one or more ranges are selected on the basis of the average number of collisions in said Time of Flight mass analyser experienced by ions corresponding to peaks of interest in said mass spectral data.

7. A method as claimed in claim 1, wherein said one or more ranges are selected on the basis of the collisional cross section ("CCS") in said Time of Flight mass analyser of ions corresponding to peaks of interest in said mass spectral data.

8. A method as claimed in claim 1, wherein modifying said frequency-domain mass spectral data comprises attenuating and/or removing said one or more ranges of said frequency-domain mass spectral data using one or more step, window, apodization or tapering functions.

9. A method as claimed in claim 8, wherein said one or more window, apodization or tapering functions comprises a function that comprises:

a maximum frequency and a minimum frequency;

wherein said function is relatively high below said maximum frequency and above said minimum frequency; and wherein said function is relatively low above said maximum frequency and below said minimum frequency.

10. A method as claimed in claim 9, wherein said function comprises an apodization or tapering function that falls smoothly to zero at said maximum frequency and/or at said minimum frequency.

11. A method as claimed in claim 9, wherein said minimum and/or maximum frequency comprise: (i) about 0 MHz; (ii) about 0.5 MHz; (iii) about 1 MHz; (iv) about 1.5 MHz; (v) about 2 MHZ; (vi) about 2.5 MHz; (vii) about 3 MHz; (viii) about 3.5 MHZ; (ix) about 4 MHz; (x) about 5 MHz; (xi) about 6 MHz; (xii) about 7 MHz; (xiii) about 8

MHz; (xiv) about 9 MHz; (xv) about 10 MHz; (xvi) about 11 MHz; (xvii) about 12 MHz; (xviii) about 13 MHz; (xix) about 14 MHz; (xx) about 15 MHz; (xxi) about 16 MHz; (xxii) about 17 MHz; (xxiii) about 18 MHz; (xxiv) about 19 MHz; and/or (xxv) about 20 MHz.

12. A method as claimed in claim 8, wherein said one or more step, apodization or tapering functions comprises a function that comprises:

a maximum frequency;

wherein said function is relatively high below said maximum frequency; and wherein said function is relatively low above said maximum frequency.

13. A method as claimed in claim 8, wherein said one or more step, apodization or tapering functions comprises a function that comprises:

a minimum frequency;

wherein said function is relatively high above said minimum frequency; and wherein said function is relatively low below said minimum frequency.

14. A method as claimed in claim 1, wherein said frequency-domain mass spectral data is modified in a predefined manner which does not depend on said mass spectral data and/or said frequency-domain mass spectral data.

15. A method as claimed in claim 1, wherein said method is performed automatically without user interaction.

16. A method as claimed in claim 1, further comprising acquiring said mass spectral data using a mass spectrometer;

wherein said steps of transforming said mass spectral data, modifying said frequency-domain mass spectral data and transforming said modified frequency-domain mass spectral data are performed in real-time concurrent with said step of acquiring said mass spectral data.

17. A method as claimed in claim 1, wherein:

transforming the mass spectral data to produce frequency-domain mass spectral data comprises performing a forward transform and wherein transforming said modified frequency-domain mass spectral data to produce modified time-domain mass spectral data comprises performing a reverse transform; or wherein transforming the mass spectral data to produce frequency-domain mass spectral data comprises performing a reverse transform and wherein transforming said modified frequency-domain mass spectral data to produce modified time-domain mass spectral data comprises performing a forward transform.

18. Apparatus comprising:

a device arranged and adapted to obtain time-domain mass spectral data using a Time of Flight ("ToF") mass analyser;

a device arranged and adapted to transform the mass spectral data to produce frequency-domain mass spectral data;

a device arranged and adapted to modify said frequency-domain mass spectral data to produce modified frequency-domain mass spectral data by attenuating and/or removing one or more ranges of said frequency-domain mass spectral data that relate to peak skirting noise associated with peaks of interest in said mass spectral data by attenuating and/or removing frequencies from said frequency-domain mass spectral data that are below a threshold frequency; and a device arranged and adapted to transform said modified frequency-domain mass spectral data to produce modified time-domain mass spectral data.

19. A mass spectrometer comprising the apparatus of claim 18.

* * * * *